US011083312B2

(12) United States Patent
Bersagel et al.

(10) Patent No.: US 11,083,312 B2
(45) Date of Patent: Aug. 10, 2021

(54) SHELF ASSEMBLY

(71) Applicant: EasyFill AB (publ), Bräcke (SE)

(72) Inventors: Henning Bersagel, Stavanger (NO); Håkan Sjölander, Bräcke (SE)

(73) Assignee: EasyFill AB (publ)

( * ) Notice: Subject to any disclaimer, the term of this patent is extended or adjusted under 35 U.S.C. 154(b) by 0 days.

(21) Appl. No.: 16/954,863

(22) PCT Filed: Dec. 18, 2017

(86) PCT No.: PCT/EP2017/083221
§ 371 (c)(1),
(2) Date: Jun. 17, 2020

(87) PCT Pub. No.: WO2019/120465
PCT Pub. Date: Jun. 27, 2019

(65) Prior Publication Data

US 2021/0085100 A1 Mar. 25, 2021

(51) Int. Cl.
*A47F 5/00* (2006.01)
*A47B 49/00* (2006.01)
(Continued)

(52) U.S. Cl.
CPC ..... *A47F 5/0087* (2013.01); *A47B 49/004* (2013.01); *A47B 57/26* (2013.01);
(Continued)

(58) Field of Classification Search
CPC ..... A47F 5/0087; A47F 5/0081; A47F 5/02; A47F 5/10; A47F 5/103; A47F 5/12;
(Continued)

(56) References Cited

U.S. PATENT DOCUMENTS 1,482,172 A * 1/1924 Weis ..... A47B 88/48 312/323
1,957,800 A * 5/1934 Powell ..... B42F 17/18 312/322

(Continued)

FOREIGN PATENT DOCUMENTS

CN 201088283 Y 7/2008
CN 103565120 A 2/2014

(Continued)

*Primary Examiner* — Jennifer E. Novosad
(74) *Attorney, Agent, or Firm* — Condo Roccia Koptiw LLP

(57) ABSTRACT

A shelf assembly (1) for products comprising a shelving section (5) with at least one shelf (6), which is rotatable about an axis of rotation (13) between a display position, in which the shelf is accessible from the front (7) of the shelving section, and a refill position, in which the shelf is accessible from the rear (8) of the shelving section. The shelf assembly further comprises a support (9), which has a sledge (10) rotatably supporting the shelving section and being movable in a forward-rearward direction. When the shelving section is rotated from the display position to the refill position, the sledge is first moved forwards, and then rearwards back to its starting position. The shelving section further comprises a frame (16) having opposite first and second side posts (17, 18), wherein the shelf is mounted between the side posts at art arbitrary height. The shelf is provided with a respective clamping portion at opposite ends of the shelf, fixing the shelf at the side posts. Each clamping portion comprises a hook portion engaged with a respective side post at a first surface thereof, and a tightening portion engaged with an opposite second surface of the side post, wherein the tightening portion is untightenable for arbitrary height movement of the shelf.

20 Claims, 5 Drawing Sheets

(51) Int. Cl.
*A47B 57/26* (2006.01)
*A47B 57/54* (2006.01)
*A47B 61/02* (2006.01)
*A47F 5/10* (2006.01)

(52) U.S. Cl.
CPC ..... *A47B 57/54* (2013.01); *A47B 61/02* (2013.01); *A47F 5/103* (2013.01)

(58) Field of Classification Search
CPC .. A47F 5/16; A47F 3/004; A47F 3/063; A47F 2003/066; A47F 3/10; A47B 49/004; A47B 57/26; A47B 61/003; A47B 49/00; A47B 2031/002; A47B 31/04; A47B 43/00; A47B 45/00; A47B 53/00; A47B 61/02; A47B 57/18; A47B 57/44; A47B 57/54; A47B 57/402; A47B 88/48; A47B 46/00; A47B 96/00
USPC ..... 211/144, 187, 150, 163, 165, 174, 103, 211/175; 312/322, 350, 309, 305
See application file for complete search history.

(56) References Cited

U.S. PATENT DOCUMENTS 2,647,812 A * 8/1953 Saunders ..... F25D 25/027 312/294
2,840,438 A * 6/1958 Sharpe ..... F25D 25/027 312/322
3,981,251 A * 9/1976 Damberg ..... F16B 12/50 108/154
4,029,211 A * 6/1977 Marshall ..... A47B 61/02 211/104
4,124,262 A * 11/1978 Schill ..... A47B 49/004 16/378
4,237,798 A * 12/1980 Welsch ..... A47B 57/26 108/147.14
4,300,809 A * 11/1981 Brownlee ..... A47B 63/062 108/139
4,723,819 A * 2/1988 Ramberg ..... A47F 7/08 211/129.1
5,065,873 A * 11/1991 Tseng ..... A47B 57/54 211/187
5,605,238 A * 2/1997 Jacobs ..... A47B 47/0091 108/180
5,657,884 A * 8/1997 Zilincar, III ..... A47F 5/0043 211/103
6,039,422 A * 3/2000 Butters ..... A47B 45/00 16/422
6,076,906 A * 6/2000 Royal ..... A47B 46/00 312/223.1
6,086,171 A * 7/2000 Ashley ..... A47B 61/04 211/163
6,199,966 B1 * 3/2001 Fulterer ..... A47B 88/42 312/270.3
7,832,816 B2 * 11/2010 Compagnucci ..... A47B 88/42 312/334.24
7,946,543 B2 * 5/2011 Cotter ..... A47F 3/08 248/159
8,511,487 B2 * 8/2013 Andersen ..... A47F 1/12 211/144
9,723,922 B2 * 8/2017 Chen ..... A47B 88/57
9,756,938 B2 * 9/2017 Ueda ..... A47B 57/04
10,334,967 B2 * 7/2019 Mercier ..... A47F 5/0087
10,443,923 B2 * 10/2019 Jeon ..... F25D 23/04
2004/0213631 A1 * 10/2004 Basler ..... F16B 7/18 403/256
2004/0226903 A1 * 11/2004 Wang ..... A47B 57/045 211/187
2004/0232810 A1 * 11/2004 Kreyenkamp ..... A47B 88/48 312/322
2006/0163984 A1 * 7/2006 Andersen ..... A47F 3/0486 312/401
2007/0048112 A1 * 3/2007 Andersen ..... A47F 5/0087 414/466
2009/0051256 A1 * 2/2009 Compagnucci ..... A47B 81/002 312/322
2009/0184078 A1 * 7/2009 Lee ..... A47B 57/54 211/187
2010/0122963 A1 * 5/2010 Costa ..... A47G 25/746 211/94.01
2011/0062101 A1 * 3/2011 Todd, Jr. ..... A47B 88/48 211/144
2011/0187250 A1 * 8/2011 Larson ..... G09F 23/00 312/322
2013/0313212 A1 * 11/2013 Lindo ..... A47K 17/00 211/119.011
2015/0034577 A1 * 2/2015 Cash ..... A47B 46/00 211/75
2019/0167000 A1 * 6/2019 Storck ..... A47B 88/48
2020/0154884 A1 * 5/2020 Huang ..... A47B 46/00

FOREIGN PATENT DOCUMENTS

CN 205457162 U 8/2016
CN 106343738 A 1/2017
CN 206119675 U 4/2017
CN 206390587 U 8/2017
DE 202018103969 U1 * 8/2018 ..... A47B 88/42
EP 2 091 391 B1 3/2011
EP 2 353 440 A1 8/2011
JP H10-179277 A 7/1998
WO WO 2015/169118 A1 11/2015

* cited by examiner

SHELF ASSEMBLY

CROSS REFERENCE TO RELATED APPLICATIONS

This application is the National Stage Entry under 35 U.S.C. § 371 of Patent Cooperation Treaty Application No. PCT/EP2017/083221, filed 18 Dec. 2017, the entire contents of which are hereby incorporated by reference herein.

FIELD OF THE INVENTION

The present invention relates generally to a shelf assembly with shelves for products. The shelf assembly is arranged to be placed in a limited space, and is rotatable between at least one display position, in which the shelves are accessible from the front of the shelving section, and a refill position, in which the shelves are accessible from the rear of the shelving section.

BACKGROUND OF THE INVENTION

In supermarkets and department stores there are many different types of shelf assemblies, which are filled with products offered for sale. Many of these products must for various reasons, such as open-dating or refrigerating reasons, be supplied in such a manner that the last supplied products are positioned in the rear part of the shelf. At the same time this satisfies the requirement that the product first supplied is also first sold. The rotatable shelf assembly satisfies these needs, and also facilitates the operation of refilling the shelves with further products when they start to become empty. EP2091391 discloses a prior art shelf assembly of this kind.

However, the shelf assembly of EP2091391 has generated a demand for further simplified refilling operations.

SUMMARY OF THE INVENTION

It would be advantageous to simplify the refilling operation. To better address this concern, in a first aspect of the invention there is presented a shelf assembly for products to be placed in a space, which at least is limited in depth by a rear boundary surface and laterally by lateral boundary surfaces, the shelf assembly having a shelving section with a front and a rear, which shelving section comprises a shelf, the shelving section being rotatable about an axis of rotation between a display position, in which the shelf is accessible from the front of the shelving section, and a refill position, in which the shelf is accessible from the rear of the shelving section, wherein the shelf assembly further comprises a support, which comprises a sledge rotatably supporting the shelving section, and being movable in depth of the space, in a forward-rearward direction, and an arm having a first end pivotally connected with the shelving section at a bottom end thereof, at a distance from the axis of rotation, and having a second end pivotally connected with a fixed portion of the support, such that when the shelving section is rotated from the display position to the refill position, due to the arm, which is pivoting during the rotation, the sledge is first moved forwards a distance from a starting position, and then rearwards back to its starting position, and wherein the shelving section further comprises a frame having opposite first and second side posts, wherein the shelf is mounted between the side posts at an arbitrary height, wherein the shelf is provided with a respective clamping portion at opposite ends of the shelf, wherein the clamping portions fix the shelf at the side posts, wherein each clamping portion comprises a hook portion engaged with a respective side post at a first surface thereof, and a tightening portion engaged with an opposite second surface of the side post, whereby the side post is clamped between the hook portion and the tightening portion, and wherein the tightening portion is untightenable for arbitrary height movement of the shelf.

The combination of a rotation solution where the shelving section does not protrude more from the space in the refill position than in the display position, contrary to the shelving section of the above-mentioned prior art, and the shelf, or shelves, being arbitrarily height adjustable does indeed simplify the refilling operation.

In accordance with an embodiment of the shelf assembly, the shelf comprises an end plate at each end thereof, wherein the clamping portion is attached to the end plate, wherein the hook portion and the tightening portion are attached to the end plate with a mutual spacing, and wherein the hook portion comprises a first edge surface protruding from the end plate and being engaged with the first surface of the side post, and a second edge surface extending perpendicular to the first edge surface and being engaged with a third surface of the side post extending perpendicular to and adjacent to the first surface. Thereby the hook portions advantageously grip around a respective corner of each side post, and fixes the lateral position of the shelf.

In accordance with an embodiment of the shelf assembly, the tightening portion comprises a nut attached to the side plate, and a screw arranged at the nut, protruding from the nut towards the hook portion and being engaged with the second surface of the side post, wherein the screw is arranged to be loosened to untighten the tightening portion. The nut and screw is classic per se, but is advantageously simple in this context.

In accordance with an embodiment of the shelf assembly, the sledge is provided with wheels at an underside of the sledge, which wheels are running in guide tracks. Thereby the reciprocating movement of the sledge in the forward-rearward direction is well controlled, and the shelving section is moved with low friction and low force.

In accordance with an embodiment of the shelf assembly, it comprises a top holder, wherein the top of the shelving section is rotationally connected with a top holder, which top holder struts the shelving section.

In accordance with an embodiment of the shelf assembly, the top holder comprises a telescoping beam rotationally connected with the shelving section at a top thereof and telescoping forward and rearward, and wherein the telescoping beam is moving in a housing, which is a fixed part of the shelf assembly.

BRIEF DESCRIPTION OF THE DRAWINGS

The invention will now be described in more detail and with reference to the appended drawings in which.

DESCRIPTION OF EMBODIMENTS

Figure 1:
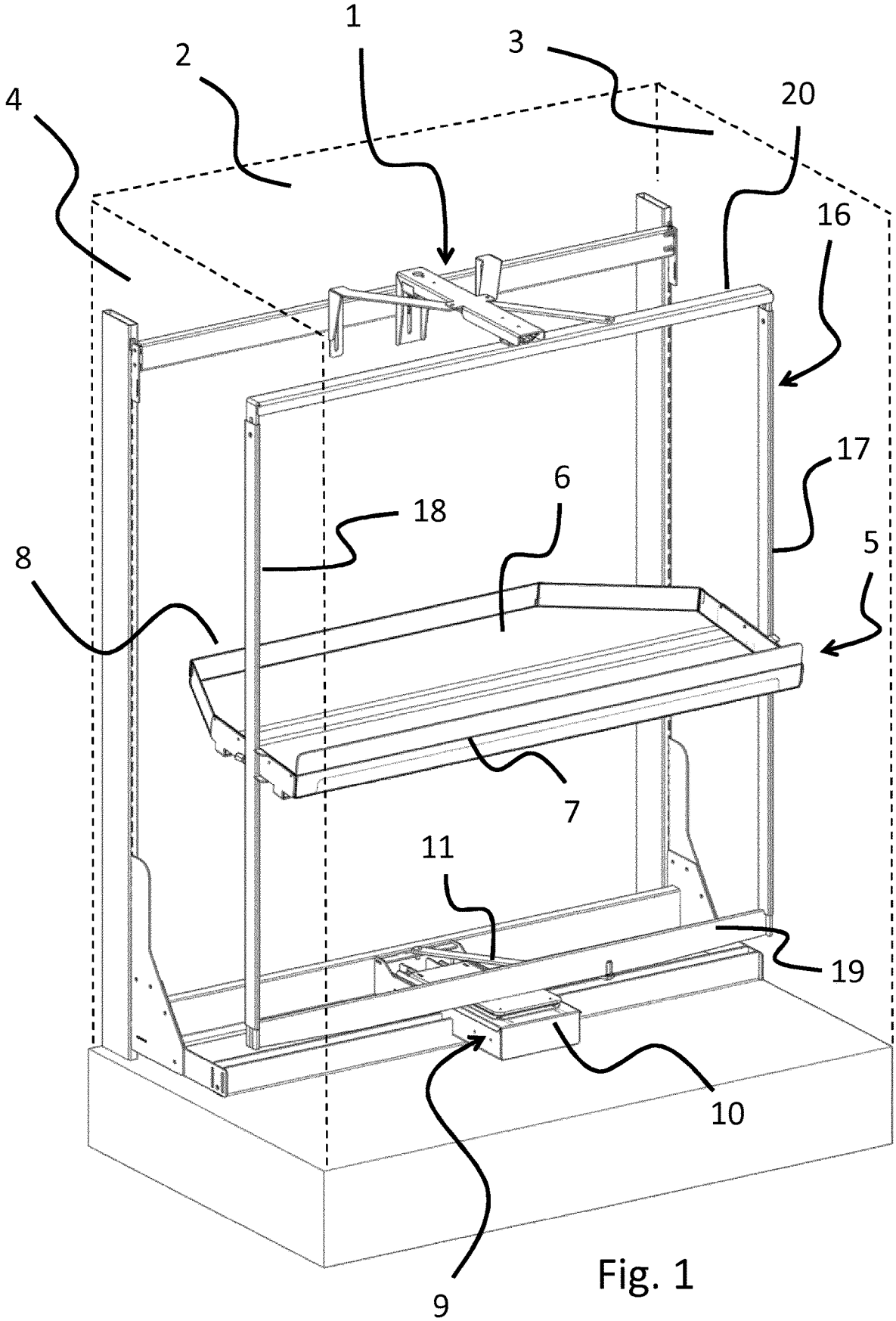
FIG. 1 shows a schematic perspective view of an embodiment of the shelf assembly according to the present invention mounted in a space.

As shown in FIG. 1 an embodiment of the shelf assembly 1 according to the present invention arranged in a space defined by a rear wall 2, providing a rear boundary surface, and side walls 3, 4, providing lateral boundary surfaces, attached to the rear wall 2 at its side edges. The rear and side walls 2-4 are merely schematically shown and in practice they can be walls of any kind, such as fixed walls of a room, walls of a cooler or freezer of a store, walls of a freestanding goods shelf, etc. The shelf assembly comprises a shelving section 5 having at least one shelf 6. Ususally the shelving section 5 comprises several vertically spaced-apart shelves 6, but single shelf alternatives are also encompassed by this application. The shelving section 5 has a front 7 and a rear 8, and is rotatable about an axis of rotation between at least one display position, shown in FIG. 1, in which the shelf is accessible from the front of the shelving section, and a refill position, in which the shelf is accessible from the rear 8 of the shelving section 5. Preferably, the shelves 6 are of a gravity-feeding kind. The term gravity-feeding means that the shelves 6 are slopingly mounted and provided with a surface that allows the products placed on the shelves 6 to move forwards and downwards along the surface towards the opening of the space, as known per se from the prior art. The shelf assembly 1 further comprises a support 9, which comprises a sledge 10 rotatably supporting the shelving section 5, and being movable in depth of the space, in a forward-rearward direction, i.e. in a reciprocating movement towards the front opening of the space and towards the rear wall 2. The shelving section 5 further comprises a frame 16 having opposite spaced apart first and second side posts 17, 18 one of which is visible in the figures, a bottom bar 19, and a top bar 20. The shelf 6 is mounted between the side posts 17 at an arbitrary height, which is adjustable as will be further described below.

The movement of the sledge is guided by guide tracks 28 (FIG. 2) comprised in the fixed portion 15 (FIG. 2) of the support 9. More particularly, the sledge 10 is provided with wheels at an underside of the sledge 10, which wheels are running in the guide tracks 28.

Figure 2:
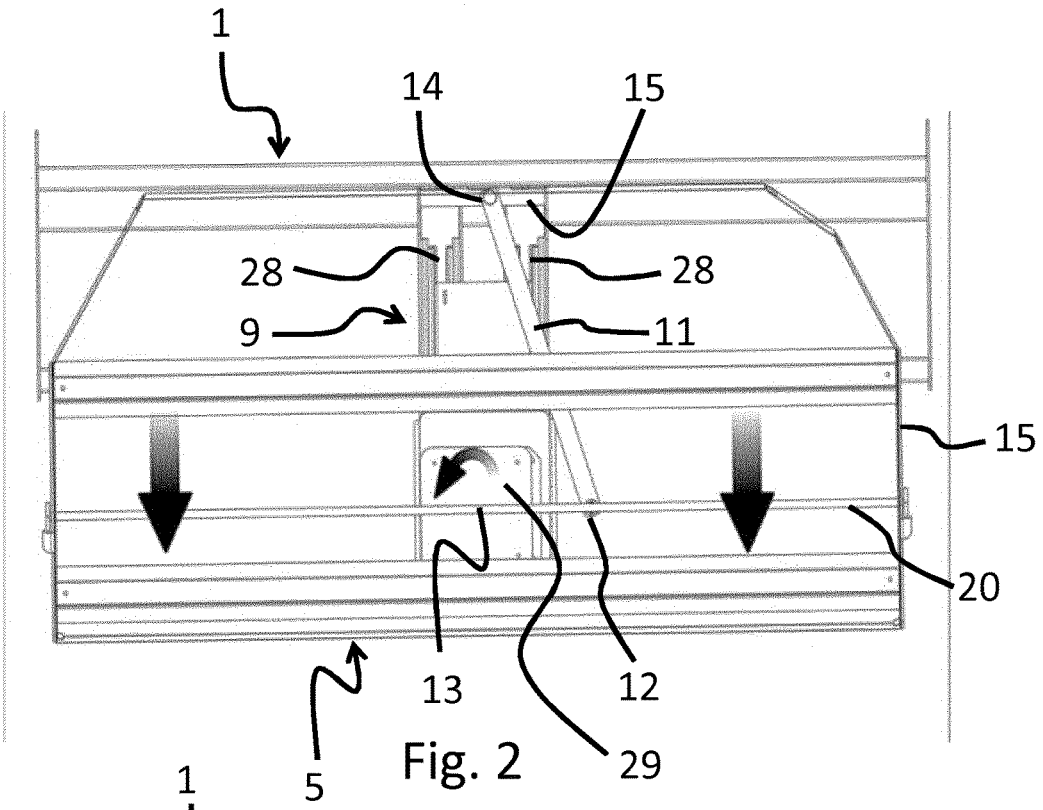
FIGS. 2-6 schematically illustrate the operation of rotating a shelving section of the shelf assembly.
Figure 3:
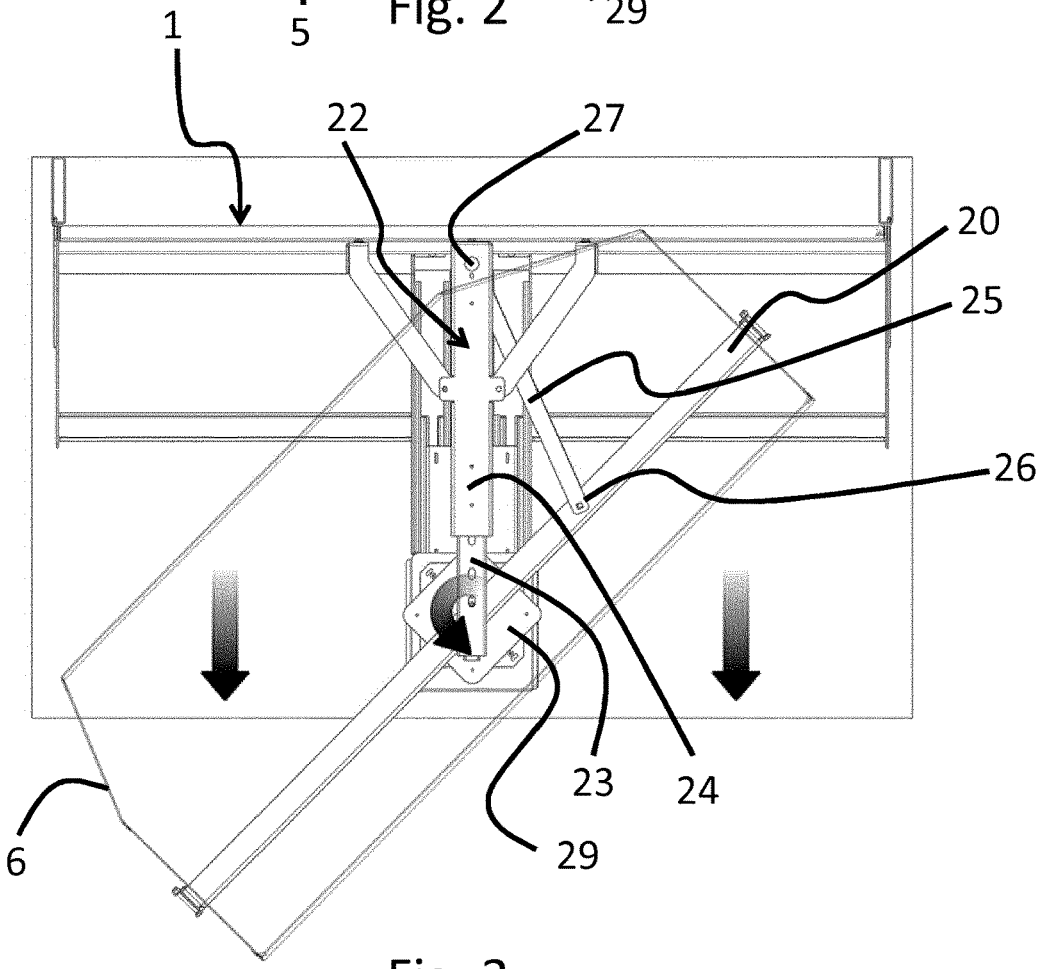

The support 9 further comprises a base plate 29 (FIGS. 2&3). The bottom bar 19 is attached to the top surface of the base plate 29, and a rotation device (not shown) is attached to a bottom surface of the base plate 29 and to a top surface of the sledge 10. The rotation device can be of any suitable common type known to the person skilled in the art, such as a ball bearing structure, etc.

Referring to FIG. 2, where the shelf 6 is shown from above and transparent, or with cut out portions, and the top holder (FIGS. 3-6) removed, to uncover the support 9 underneath, the support 9 further comprises an arm 11 having a first end 12 pivotally connected with the shelving section 5 at a bottom end thereof, at a distance from a central axis of rotation 13 of the shelving section 5, and a second end 14 pivotally connected with a fixed portion 15 of the support 9. When the shelving section 5 is rotated from the display position to the refill position, due to the arm 11, which is pivoting during the rotation, the sledge 10 is first moved forwards a distance from a starting position, illustrated in FIG. 2, and then rearwards back to its starting position. The distance corresponds to the distance between the central rotation axis 13 and the pivot connection at the second end of the arm 11. More particularly, when a person grabs the shelving section 5 at a position displaced from the centre, and preferably close to one side or the other, and starts pulling it, the shelving section 5 will start to rotate while the sledge 10 starts moving forwards. The rotation is shown in steps in FIGS. 2-6, and it is assumed that the person pulls the shelving section 5 to the left of the central rotation axis 13 in FIG. 2. Since the arm 11 is rigid, when the shelving section 5 is pulled forwards the bottom bar 19 pivots about the first end 12 of the arm 11, and thereby the sledge 10 starts moving forwards, since its lateral position is fixed. Simultaneously the arm 11 starts pivoting about its second end 14 towards the centre of the shelving section 5, i.e. to the left in FIG. 2.

Figure 4:
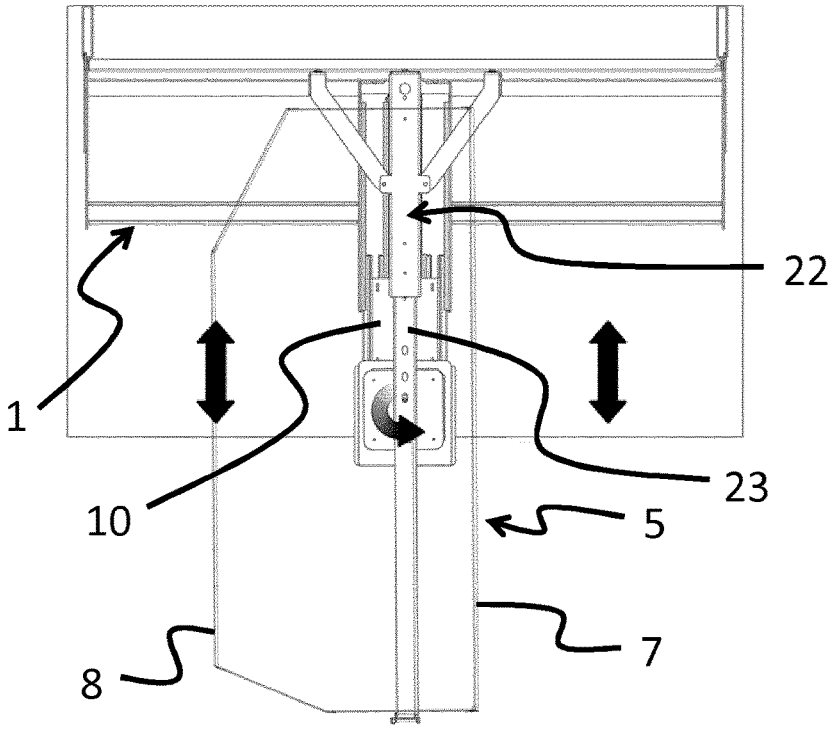
Figure 5:
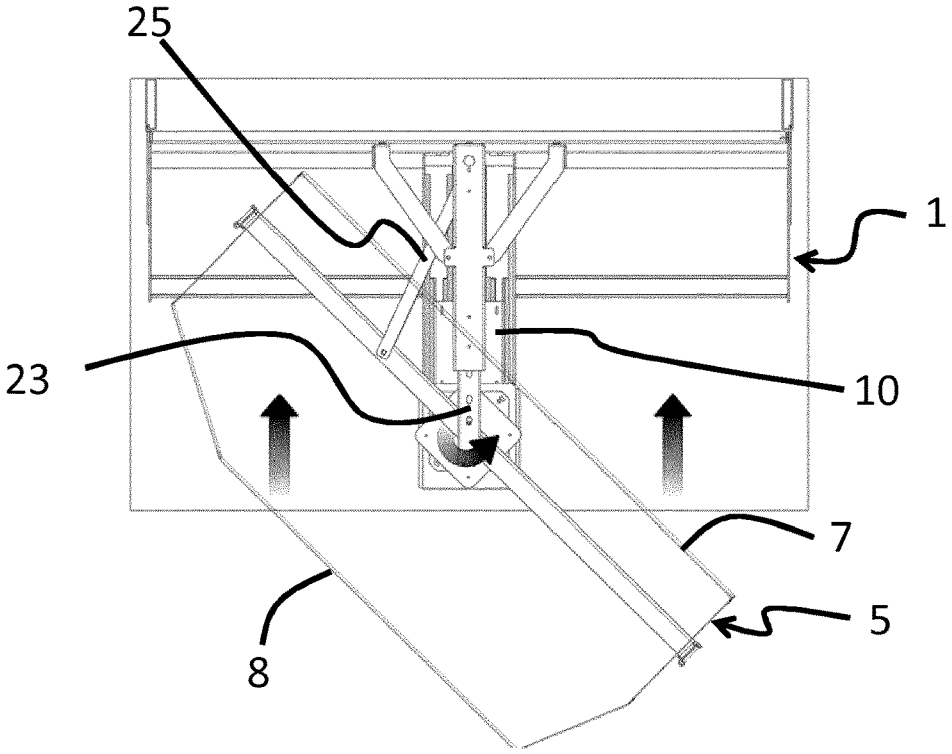
Figure 6:
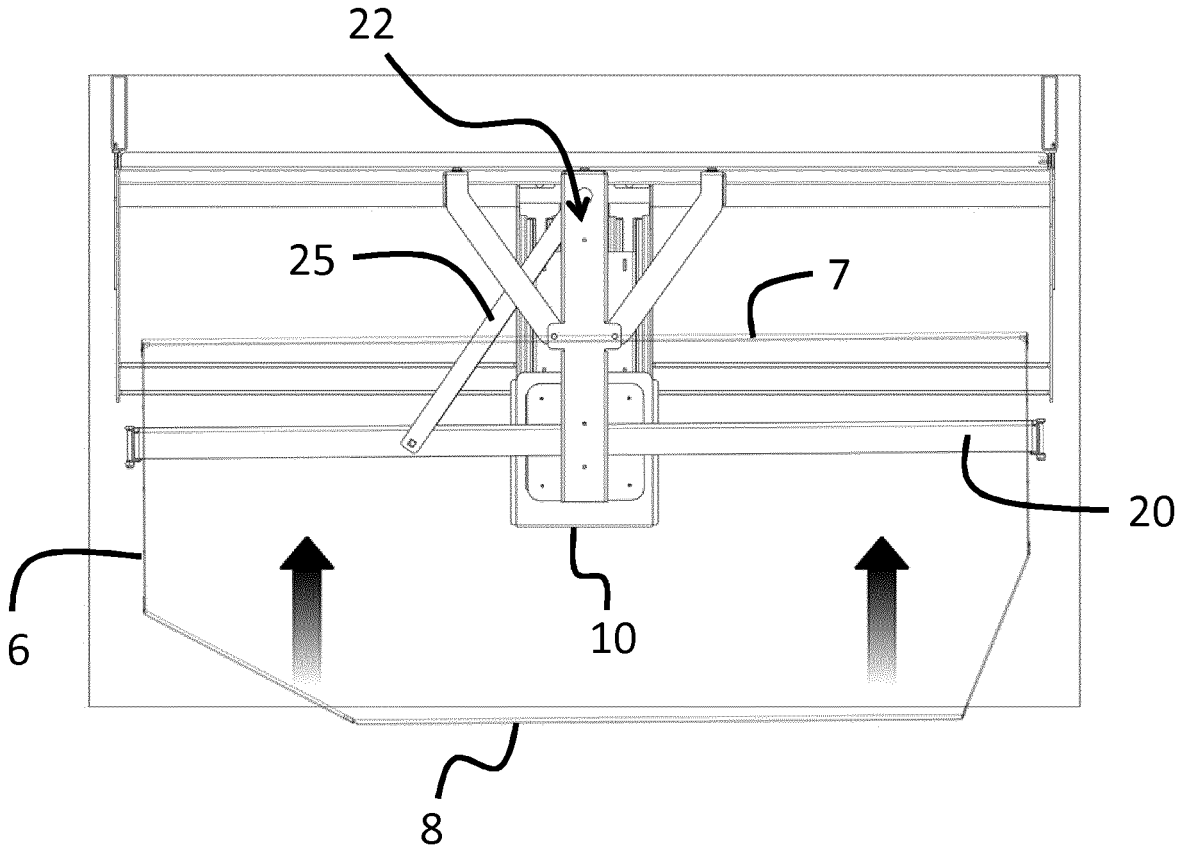

As shown in FIGS. 3-6, which are views from above the whole shelf assembly 1, in this embodiment the shelf assembly 1 comprises a structure at its top which structure resembles the support 9 at the bottom of the shelving section 5. More particularly, the top of the shelving section 5 is rotationally connected with a top holder 22, which top holder 22 struts the shelving section 5. The top holder 22 is not necessary if the support is made strong enough, but advantageous to enable a slimmer support 9. The top holder 22 comprises a telescoping beam 23 rotationally connected with the shelving section 5 at a top thereof and telescoping forward and rearward. The telescoping beam 23 is moving in a housing 24, which is a fixed part of the shelf assembly 1. Like the support 9 the top holder comprises an arm 25, which is vertically aligned with the arm 11 of the support 9. Therefore, the arm 11 of the support 9 is not visible in FIGS. 3-6, because it is blocked by the arm 25 of the top holder 22. The arm 25 of the top holder 22 is pivotally connected, at a first end 26 thereof, with the top bar 20, at the same distance from the central rotation axis as the arm 11 of the support 9. At a second end 27 of the arm 25 it is pivotally connected with the housing 24 at a rear end of the housing 24. When the operation of rotating the shelving section 5 is continued, it is moved further forwards, as shown in FIGS. 3 and 4, and thereby the shelf 6 avoids hitting the rear wall 2. The sledge 10 reaches its forward most position when the shelving section 5 has been rotated 90 degrees, shown in FIG. 4. In this position the arm 25 of the top holder 22 extends along the housing 24, and is hidden below it in the figure. During the continued rotation, shown in FIG. 6, the sledge 10, and thus the shelving section 5, moves back rearwards to its starting position in the forward-rearward direction. Now the shelving section 5 has been rotated to its refill position, and in depth of the space it has the same position as in the display position. Consequently, the shelf 6 does not protrude out of the space as in the above-mentioned prior art shelf assembly. The arms 11, 25 have pivoted to a position where their first ends are positioned to the left of the central rotation axis 13 at the same distance as they were position to the right of the central rotation axis 13 in the display position.

Figure 7:
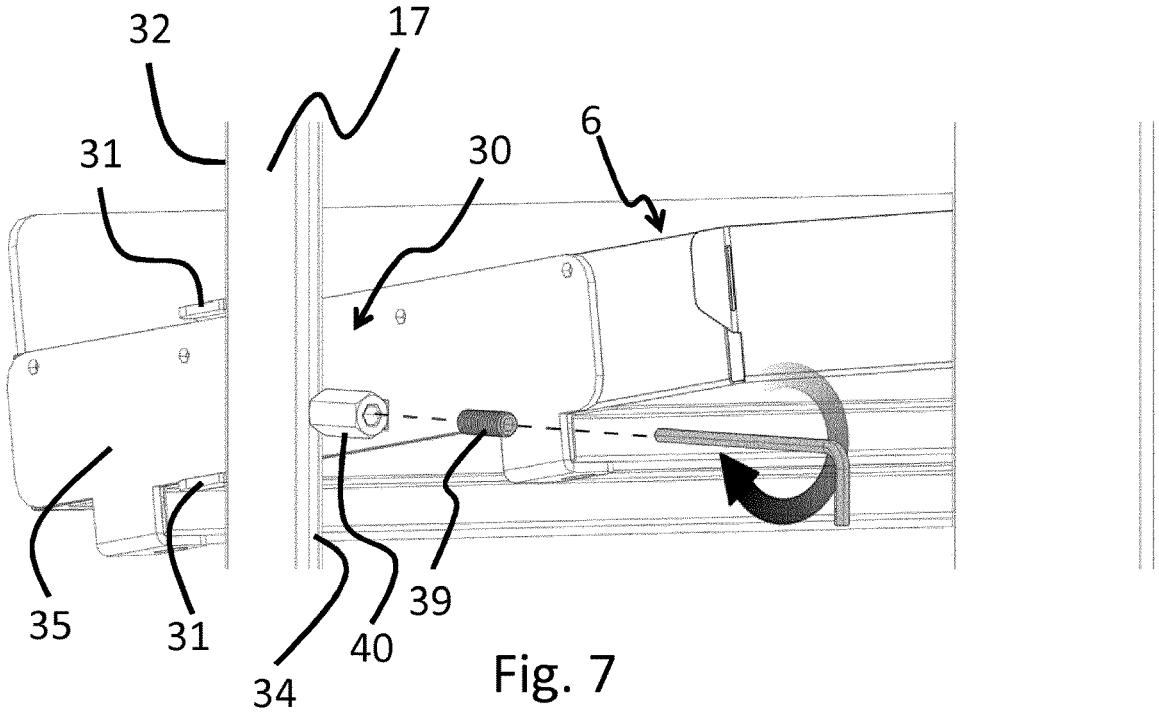
FIGS. 7-8 show schematic perspective views of a part of a shelf of the shelf assembly.
Figure 8:
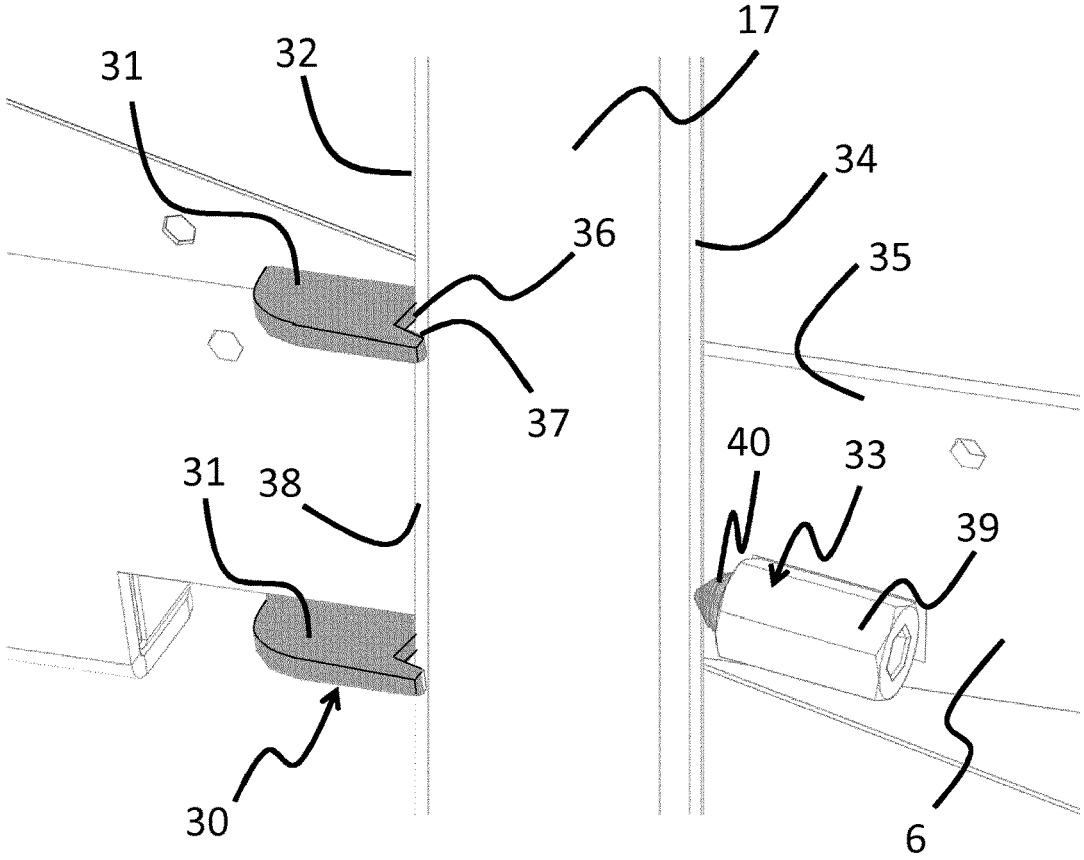

Referring now to FIGS. 7 and 8, the shelf 6 is provided with a respective clamping portion 30 at opposite ends of the shelf 6, wherein the clamping portions 30 fix the shelf 6 at the side posts 17, 18. Each clamping portion 30 comprises a hook portion 31 engaged with a respective side post 17, 18 at a first surface 32 of the side post 17, and a tightening portion 33 engaged with an opposite second surface 34 of the side post 17, whereby the side post 17 is clamped between the hook portion 31 and the tightening portion 33, and wherein the tightening portion 33 is untightenable for arbitrary height movement of the shelf 6. More particularly, the shelf 6 comprises an end plate 35 at each end thereof, wherein the clamping portion 30 is attached to the end plate 35, wherein the hook portion 31 and the tightening portion 33 are attached to the end plate 35 with a mutual spacing, and wherein the hook portion 31 comprises a first edge surface 36 protruding from the end plate 35 and being engaged with the first surface 32 of the side post, and a second edge surface 37 extending perpendicular to the first edge surface 36 and being engaged with a third surface 38 of the side post 17 extending perpendicular to and adjacent to the first surface 32.

The tightening portion 33 comprises a nut 39 attached to the side of the end plate 35, and a screw 40 arranged at the nut 39, protruding from the nut 39 towards the hook portion 31, and being engaged with the second surface 34 of the side post 17, wherein the screw 40 is arranged to be loosened to untighten the tightening portion 33.

While the invention has been illustrated and described in detail in the drawings and foregoing description, such illustration and description are to be considered illustrative or exemplary and not restrictive. The invention is not limited to the disclosed embodiment.

Other variations to the disclosed embodiment can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A shelf assembly for products to be placed in a space limited in depth by a rear boundary surface and laterally by lateral boundary surfaces, the shelf assembly comprising:

a shelving section comprising:

a frame having opposite first and second side posts; and a shelf having a front, a rear, and a respective clamping portion at opposite ends of the shelf, wherein the clamping portions fix the shelf at the side posts at an arbitrary height, wherein each clamping portion comprises a hook portion engaged with a respective side post at a first surface thereof, and a tightening portion engaged with an opposite second surface of the side post, whereby the side post is clamped between the hook portion and the tightening portion, and wherein loosening of the tightening portion allows for adjustable height movement of the shelf;

wherein the shelving section is rotatable about an axis of rotation between a display position, in which the shelf is accessible from the front, and a refill position, in which the shelf is accessible from the rear; and a support for rotatably supporting the shelving section, the support comprising:

a sledge being movable in the depth of the space in a forward-rearward direction, and an arm having a first end pivotally connected with the shelving section at a bottom end thereof at a distance from the axis of rotation, and having a second end pivotally connected with a fixed portion of the support, such that as the sledge moves, the shelving section is rotated from the display position to the refill position.

2. The shelf assembly of claim 1, wherein, during rotation of the shelving section about the axis of rotation, the sledge is first moved forwards a distance from a starting position, and then rearwards back to its starting position.

3. The shelf assembly of claim 1, wherein the shelf further comprises an end plate at each end thereof, wherein the clamping portion is attached to the end plate, wherein the hook portion and the tightening portion are attached to the end plate with a spacing.

4. The shelf assembly of claim 3, wherein the hook portion comprises a first edge surface protruding from the end plate and being engaged with the first surface of the side post, and a second edge surface extending perpendicular to the first edge surface and being engaged with a third surface of the side post extending perpendicular to and adjacent to the first surface.

5. The shelf assembly of claim 3, wherein the tightening portion comprises a nut attached to the end plate and a screw protruding from the nut to engage the second surface of the side post, wherein the screw is arranged to be loosened to untighten the tightening portion.

6. The shelf assembly of claim 1, wherein the sledge is provided with wheels at an underside of the sledge, wherein the wheels move in guide tracks.

7. The shelf assembly of claim 1, further comprising a top holder, wherein the top of the shelving section is rotationally connected with the top holder.

8. The shelf assembly of claim 7, wherein the top holder comprises a telescoping beam rotationally connected with the shelving section at a top thereof and telescoping forward and rearward, and wherein the telescoping beam is moving in a housing which is a fixed part of the shelf assembly.

9. A shelf assembly, comprising:

a shelf adapted to be disposed in an opening and being connected to a frame, the shelf having a front, a rear, and a respective clamping portion at opposite ends of the shelf for engaging the frame, wherein the shelf is moveable in a vertical direction within the opening by adjusting a height of the shelf, wherein the shelf is moveable in a translational direction out of or into the opening guided by at least one of a sledge or a telescoping beam attached to the frame, and wherein the shelf is moveable in a rotational direction about an axis of rotation between a display position, in which the shelf is accessible from the front, and a refill position, in which the shelf is accessible from the rear; and an arm having a first end pivotally connected with the frame at a distance from the axis of rotation, and having a second end pivotally connected at a fixed point, such that as the at least one of the sledge or the telescoping beam moves, the shelf is rotated from the display position to the refill position.

10. The shelf assembly of claim 9, wherein the shelf is prevented from moving in a direction perpendicular to the translational direction by the frame.

11. The shelf assembly of claim 9, wherein a major portion of the shelf does not extend out from the opening during any of the vertical, translational, or rotational movement.

12. The shelf assembly of claim 9, wherein the opening is of a fixed width and abuts respective outer sides of the frame.

13. The shelf assembly of claim 9, comprising a sledge.

14. The shelf assembly of claim 13, wherein the sledge is movable in a forward-rearward direction.

15. The shelf assembly of claim 13, wherein, during rotation of the shelf about the axis of rotation, the sledge is first moved forwards a distance from a starting position, and then rearwards back to its starting position.

16. The shelf assembly of claim 13, wherein the sledge is provided with wheels at an underside of the sledge, wherein the wheels move in guide tracks.

17. The shelf assembly of claim 9, comprising a telescoping beam.

18. The shelf assembly of claim 17, wherein the telescoping beam telescopes forward and rearward.

19. The shelf assembly of claim 9, wherein at maximum extension of at least one of the sledge or the telescoping beam in the translational direction, the shelf is rotated 90 degrees.

20. A shelf assembly, comprising:

a stationary frame adapted to be disposed in an opening;

a rotatable frame rotationally and translationally mounted to the stationary frame;

a shelf connected to the rotatable frame, the shelf having a front, a rear, and a respective clamping portion at opposite ends of the shelf for engaging the rotatable frame and adjusting a height of the shelf;

at least one of a sledge or a telescoping beam attached to the rotatable frame and moveable in a translational direction out of or into the opening; and an arm having a first end pivotally connected with the rotatable frame at a distance from an axis of rotation, and having a second end pivotally connected to the stationary frame, such that as the sledge and/or telescoping beam moves, the shelf moves in a rotational direction about an axis of rotation between a display position, in which the shelf is accessible from the front, and a refill position, in which the shelf is accessible from the rear.

* * * * *